US008894155B2

(12) United States Patent
Elfgen

(10) Patent No.: US 8,894,155 B2
(45) Date of Patent: Nov. 25, 2014

(54) METHOD FOR ATTACHING A CHISEL AND ASSOCIATED DEVICE

(71) Applicant: Henk Roland van Marum, Ommen (NL)

(72) Inventor: Gerd Elfgen, Wesseling (DE)

(73) Assignee: Henk Roland van Marum, Ommen (NL)

( * ) Notice: Subject to any disclaimer, the term of this patent is extended or adjusted under 35 U.S.C. 154(b) by 37 days.

(21) Appl. No.: 13/737,181

(22) Filed: Jan. 9, 2013

(65) Prior Publication Data

US 2014/0191563 A1 Jul. 10, 2014

(51) Int. Cl.
*E21C 35/18* (2006.01)
*E21C 35/183* (2006.01)
*E21C 35/19* (2006.01)

(52) U.S. Cl.
CPC ..... *E21C 35/183* (2013.01); *E21C 2035/191* (2013.01)
USPC ..... 299/106

(58) Field of Classification Search
CPC ..... E21C 2035/19; E21C 2035/191
USPC ..... 299/106
See application file for complete search history.

(56) References Cited

U.S. PATENT DOCUMENTS

| | | | | | |
|---|---|---|---|---|---|
| 4,299,424 | A * | 11/1981 | LeBegue et al. | ..... | 299/103 |
| 4,337,980 | A * | 7/1982 | Krekeler | ..... | 299/102 |
| 5,092,660 | A * | 3/1992 | Steinkuhl et al. | ..... | 299/103 |
| 5,318,351 | A * | 6/1994 | Walker | ..... | 299/106 |
| 6,585,326 | B2 * | 7/2003 | Sollami | ..... | 299/104 |
| 7,891,084 | B1 * | 2/2011 | Sollami | ..... | 29/760 |
| 8,267,483 | B2 * | 9/2012 | Kramer et al. | ..... | 299/104 |

FOREIGN PATENT DOCUMENTS

| | | |
|---|---|---|
| DE | 296 23 215 | 1/1998 |
| DE | 10 2008 010 609 | 9/2009 |

* cited by examiner

*Primary Examiner* — John Kreck
(74) *Attorney, Agent, or Firm* — Collard & Roe, P.C.

(57) ABSTRACT

The invention relates to a device for machining and/or conveying materials, comprising a roller element rotatably supported about a longitudinal axis, at least one tool holder, a support element for supporting a cutting tool and a cutting tool, wherein the tool holder includes a receiver in which the support element is received in a form locking manner and the support element includes a bore hole. In order to configure the support element that is provided for holding the cutting tool engaging the material so that it can be exchanged in a much simpler manner it is proposed to arrange the fixation element coaxial with the support element, wherein the fixation element is connected with the support element through a threaded connection.

17 Claims, 14 Drawing Sheets

METHOD FOR ATTACHING A CHISEL AND ASSOCIATED DEVICE

INTRODUCTION

Figure 1:
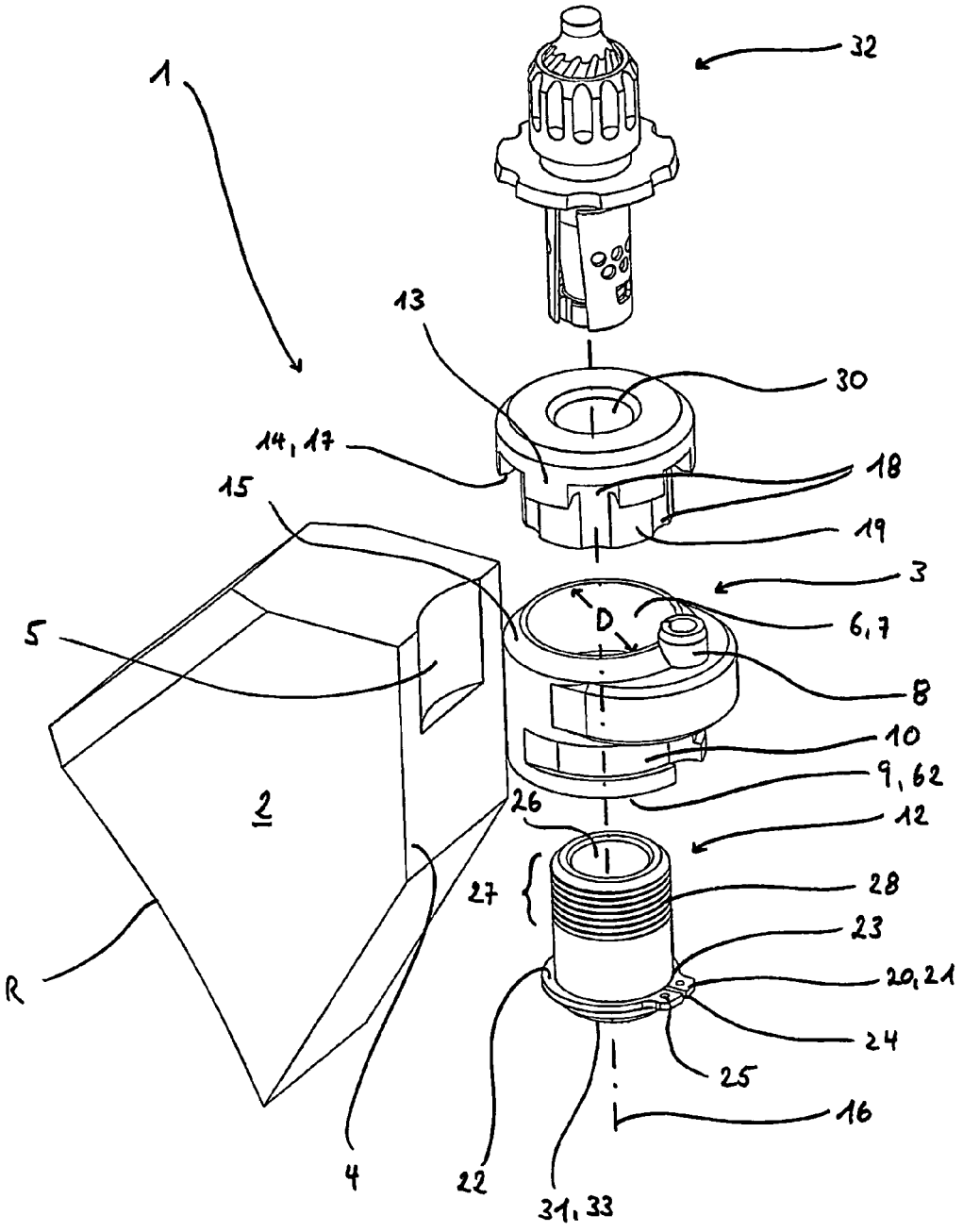

The invention relates to a device for machining and/or conveying materials including a roller element rotatably supported about a longitudinal axis, at least one tool holder a support element for supporting a cutting tool and a cutting tool, wherein the tool holder includes a receiver in which the support element is received in a form locking manner and wherein the support element includes a bore hole.

Furthermore the invention relates to a method for mounting a support element for supporting a cutting tool of a device for machining and/or conveying materials comprising a roller element rotatably supported about its longitudinal axis, at least one tool holder including a receiver, the support element including a bore hole, a fixation element and at least one cutting tool, comprising the following method steps:

a) connecting the at least one tool holder with the roller element;
b) arranging the support element and the fixation element separately in the receiver of the at least one tool holder;
c) bolting the support element together with the fixation element.

Devices of this general type are well known and are used for example for removing surfaces, in particular road surfaces and in the mining field or also for recycling materials of various types (metals, rock, plastic material etc.).

BACKGROUND OF THE INVENTION

For example DE 10 2008 010 609 A1 discloses a chisel-chisel holder arrangement in which a chisel is supported in a chisel holder, wherein the chisel holder in turn is insertable in a base holder. While the base holder can be considered as a tool holder in the sense of the device recited supra the chisel holder can be interpreted as support element according to the device described supra. The chisel which engages the material to be machined during machining operations can be furthermore interpreted as a cutting tool in the sense of the device recited supra.

In the device recited in the publication document the chisel is, as common in the art, inserted into a bore hole of the chisel holder and attached at this location for example through a clamping sleeve. The basic principle of arranging a cutting tool (in the recited document the chisel) at an associated milling device and configuring the cutting tool as a so called round shaft chisel rotating about its longitudinal axis has been a technical standard for quite a while and is being used in many applications. Due to the particularly strong force impact during milling operations all components of the device described supra are subject to substantial wear. This applies in particular for the cutting tool, wherein in particular the portion of the cutting tool is affected the most which is brought into direct engagement with the material to be machined (for example a chisel). Based on the high mechanical loadings the associated relatively short service lives of the cutting tools are accepted.

Various developments therefore relate in particular to the problem of low service life of portions of the device that do not come in contact with the material to be machined. Many innovations were already able to provide improvements. Current devices, however, do not sufficiently address the problem of high wear of the support element which is only used for supporting or receiving the cutting tool. Classic wear effects can be created for example in that high transversal forces transmitted from the cutting tool to the support element lead to a deformation of the initial cylindrical receiver of the support element so that the receiver in particular in a upper section loses its essentially circular cross section which becomes increasingly ellipsoid. This impacts the support of the cutting tool included therein significantly and prevents for example a reliable rotation of the cutting tool (for example provided in the form of a round shaft chisel) about its longitudinal axis. Furthermore, the cutting performance of the cutting tool is reduced since the orientation of the cutting tool with an optimum chip angle between the associated cutting element and the material to be processed is lost. Also the large pulsating axial forces transmitted through the chisel head into the support element in conjunction with the chisel rotation and abrasive components of the machine material ("grinding particles") lead to wear of the tool holder in the sense of a material removal in axial direction which in turn reduces the stability of the support. Due to this wear of the support element relatively frequent replacement of the support element is necessary. This is undesirable for several reasons.

On the one hand side the support element is typically a relatively massive and large component (c.f. tool holder according to DE 10 2008 010 609 A1), which respectively cause considerable material costs. On the other hand side replacing a bearing element of this type is rather complex in the prior art since the bearing element is typically welded together with an associated tool holder, for example a base holder and has to be disengaged with a cutting torch and subsequently welded on again so that besides high material costs high wages and down times are incurred when replacing the support element.

The utility model DE 296 23 215 U1 addresses the problem of the support element wearing out (chisel holder c.f. DE 296 23 215 U1) by using a support element. The support element is placed in a portion between the cutting tool and the bore hole of the support element so that impact loads which originate from milling operations are not directly passed from the cutting tool to the support element but are captured by the support element. However, it is detrimental that the illustrated support element is either sunk with a conical plug insert in an also conical dead hole and wedged therein or attached at the support element through a solder joint or a welded joint. Both attachment variants have the effect that the support element can either not be removed at all or that it can only be removed with substantial complexity, for example when the support element itself is heavily worn and cannot perform its protective function relative to the change holder anymore.

TECHNICAL OBJECT

Thus, it is the object of the invention to improve a device as recited supra so that the support element which is provided for holding the cutting tool that engages the material can be disassembled and replaced in a much simpler manner than in the prior art.

Solution

The object of the present invention is achieved based on a device as described supra through a fixation element according to the invention which is connected through a threaded connection with the support element in a force transferring manner, wherein the fixation element is arranged coaxial to the support element.

The support element is a typically sleeve shaped insert which is inserted into the receiver of the tool holder and acts as a buffer element between the cutting tool and the tool holder and thus substantially reduces the wear of the tool holder. Through the recited fixation element this support element is fixable at the tool holder in a particularly simple manner so that a replacement of the support element that may be required can be performed particularly quickly. Due to the threaded connection of the fixation element with the support element a welded connection of support element and tool holder is no longer required in order to keep the support element at its position. When it is determined during milling operations that the support element is worn and consequently deformed the fixation element can be disengaged from the support element through a rotating movement and the support element can be subsequently removed and replaced with a new support element. On the other hand side the threaded assembly furthermore provides the option to impart a particular tension force upon the support element, this means to tighten the support element relative to the tool holder. Thus, a substantial force can be imparted coaxial to the support element and the fixation element, for example by providing a so called "fine thread" which has a particularly low pitch through applying relatively small torques for threading the fixation element and the support element together.

Thus, the support element that is typically used according to the invention is many times smaller and handier compared to a prior art support element. Replacing the support element therefore based on the fixation element according to the invention does not only provide substantially reduced down times compared to the prior art but furthermore significantly reduces material costs.

A device is particularly advantageous whose fixation element has an outer thread in a thread section which is engageable with an inner thread of the support element. Threading the support element together with the fixation element is possible in a particularly simple manner for this configuration of the respective elements with corresponding inner and outer threads.

Similar to the prior art when using a chisel shaped cutting tool also the support element used herein is subject to mechanical wear which analogous to the description described supra leads to a deformation of the bore hole of the support element. Therefore in order to maximize the service life of the support element it should be provided that the support element is configured connectable through form locking with the tool holder in plural positions that are rotated about a longitudinal axis of the support element. As soon as an ellipsoid geometry of the receiving bore hole of the cutting tool occurs so that the cutting tool does no longer have a firm placement in the receiver and for example in case of using a chisel with circular shaft a rotation of the chisel is influenced in a negative manner, the support element can be disengaged from the fixation element and can be subsequently rotated relative to the tool holder so that a main load direction of the support element in which the cutting tool loads the support element can be replaced. Through this technique the support element is useable through multiple rotations until no orientation of the main load direction is adjustable anymore in which orientation the cutting tool is positioned substantially firmly in the receiver. This way the support element can be used in a maximum manner, so that the material cost can be kept accordingly low.

The form locking between the tool holder and the support element can be achieved in a particularly simple manner by providing an interaction between at least one groove, preferably a plurality of grooves, and at least one locking element between the support element and the tool holder, wherein either the support element includes the at least one groove and the tool holder includes the at least one locking element or vice versa. The locking element in this configuration can for example be provided pin shaped, wherein the locking element is preferably arranged at the tool holder, whereas the support element includes respective grooves.

The advantage of the device according to the invention with respect to simple assembly and also disassembly of the support element was already recited supra, wherein the advantage results from the uncomplicated and swift threading of the support element with the fixation element. The process of threading together itself can thus be provided in a particularly simple and efficient manner when the fixation element has an opening which is preferably centrally arranged, wherein said opening is preferably arranged in a bottom side of the fixation element and provided hexagonal as an inner hexagonal socket. When the fixation element is configured like that an assembly of the support element can be performed as follows:

After inserting the fixation element into the receiver of the tool holder which is subsequently addressed in detail the support element is also inserted into the receiver.

The hexagonal opening in the bottom side of the fixation element can now be used to insert a hexagonal assembly tool for bolts, a so called Allen wrench into this opening, wherein this assembly tool for bolts engages the opening of the fixation element in a form locking manner, so that a torque is transferable from the assembly tool for bolts onto the fixation element. Through a rotating movement of the assembly tool for bolts consequently also the fixation element can be rotated so that the outer thread of the fixation element engages the corresponding inner thread of the support element and is consequently threaded together therewith. The particular advantage of the combination of the support element including the bore hole and the fixation element including the central opening is that the assembly tool for bolts is insertable from a top side of the receiver of the tool holder into said receiver, wherein the assembly tool for bolts moves into the opening of the fixation element through the bore hole of the support element. Mounting the support element positioned at the top side of the receiver, thus is advantageously performed according to the invention by rotating the fixation element arranged at a bottom side of the receiver of the tool holder in that the fixation element is rotated or threaded through an assembly tool for bolts, wherein the cutting tool engages the opening of the fixation element from a side oriented towards the thread of the fixation element (from the top side of the recess). This is very unusual. Typically for bolts of all types the assembly tool for bolts is brought into form locking engagement with the associated bolt from one side which is oriented away from the thread of the bolt.

The described method is particularly advantageous because disengaging and fixating the support element is facilitated without the receiver of the tool element having to be accessible from the bottom side. Due to space constraints which are typical for devices as described supra this represents a substantial simplification. This applies even more in corner portions of the roller element since here the tool holders or the associated cutting tools are typically placed much tighter than in a center portion of the roller element so that cutting edges in the corner portions are configured with better quality. Due to the tight arrangement of the tool holders in this portion the problem of limited space is particularly pronounced herein.

In order to provide safe retention of the support element in the receiver of the tool holder it is particularly advantageous when the support element and also the fixation element have respective retention portions, i.e. support portions, which are preferably configured circumferential, wherein the support portions respectively protrude in radial direction beyond the receiver of the tool holder and are supported respectively at a support surface of the support portion oriented towards the tool holder against a respective corresponding support surface of the tool holder. When using a support- and fixation element of this type it is evident that the combination from both elements as soon as both elements are threaded together in the receiver of the tool holder is not moveable any longer in a direction parallel to a longitudinal axis of the tool holder. This is prevented through the support portions since the supports portions protrude beyond the receiver and in case of a movement of the interconnection of the support element and the fixation element directly contact the support surfaces of the tool holder with their support portions. Thus, using a support element of this type and a fixation element of this type accordingly assures that threading both elements together leads to a safe retention of the support element.

A particularly advantageous embodiment in this context includes a configuration of the retention portions, i.e. the support portions, in which the support surfaces of the support element and of the tool holder engage one another through conical engagement sections, wherein preferably the engagement section of the support element is configured as an inner cone and the engagement section of the tool holder is configured as outer cone. It was already described supra that a move ability of the support element in a direction that is parallel to the longitudinal axis of the receiver of the tool holder is prevented through the support portions. During milling operations, however, the support element is also loaded in other directions which is caused by the fact that the cutting tool supported by the support element is also loaded in other directions so that a loading that is purely parallel to the longitudinal axis with respect to the receiver of the tool holder is not provided. Rather, there are large force effects in directions transversal to the longitudinal axis ("transversal forces"). Should the support portion of the support element be configured completely planar so that the support surface of the support portion of the support element has no capability to transfer transversal forces to the tool holder, the support element is excessively loaded since it has to react all transversal forces through a portion of a wall of the support element to the tool element which portion of the wall is arranged within the receiver of the tool holder and is supported at an inner enveloping surface of the receiver. Through a conical configuration of the support surfaces relative to one another, however, a large portion of the transversal forces can be reacted directly in the support portion at an upper side of the support element or of the receiver to the tool holder which substantially relieves the loading of the support element. It is irrelevant as a matter of principle for this functionality which support surface is configured as an inner cone and as an outer cone. Due to other circumstances during milling operations, however, it is particularly advantageous to configure the embodiment as described supra, since possible contamination, for example in the form of chipped off material can only move between the tool holder and the support element with much more difficulty compared to an arrangement in which the inner cone is configured at the tool holder and the outer cone is configured at the support portion of the support element.

With respect to the fixation element a configuration of the support portion is particularly advantageous when the support portion is formed by a safety ring that is removable in a non destructive manner and wherein the safety ring is supported in a circumferential groove of the fixation element. It was already recited supra that the space conditions at the bottom side of the receiver of the tool holder can be very constricted. In analogy to the previously described advantage of insertability of the assembly tool for bolts from the top side of the receiver of the tool holder it is analogously very advantageous when there is an option to introduce the fixation element also from above into the receiver. In case the fixation element is connected tight with a support portion that extends beyond the receiver of the tool holder such introduction of the fixation element from the top side is not possible. Only through a flexible attachment and removal of the portion forming the support portion, herein designated as safety ring, the desired flexibility can be reached. Coming back to the sequence of mounting the support element recited supra this means for introducing the support element that before the insertion the safety ring should not be arranged at the fixation element since per definition no support portion is provided at the fixation element, the fixation element can be inserted from the top side into the receiver, thus until the preferably circumferential groove of the fixation element extends from the receiver on the bottom side of the receiver and is thus accessible from outside. Subsequently the safety ring can be attached in the groove, wherein the safety ring has a width so that it protrudes beyond the receiver of the tool holder after insertion into the groove of the fixation element in the sense of the function of the support portion so that the fixation element cannot be moved any longer in the direction of the top side of the receiver since the support surfaces of the tool holder and of the safety ring or of the support portion wedge relative to one another. The safety ring has to be mounted at the bottom side of the receiver at the fixation element, however, since the safety ring is a narrow component this is also easily possible under tight space conditions. After mounting the fixation element, further assembly of the support element can be performed as described supra.

After completely attaching the support element through connecting it with the fixation element, the device is ready for receiving the cutting tool. In practical applications the cutting tool is preferably formed by a round shaft chisel which is preferably used in mining and surface removal applications. The bore hole in the support element is configured for this purpose as a support bore hole for rotatably receiving a cutting tool. The receiver is accordingly configured for supporting a round shaft chisel and therefore usable for all typical applications without any restrictions.

Besides this typical embodiment, however, it can also be particularly advantageous when the support element has a cutting tool at its top side that is tightly connected with the support element. The cutting tool is accordingly arranged on the retention portion of the support element.

A cutting tool of this type can for example include a cutting element that is configured as a cutting plate which is preferably formed from hard metal, wherein the cutting plate is preferably configured as a circular ring shaped or hexagonal cutting plate. The cutting plate, irrespective, whether circular ring shaped or hexagonal should therefore be arranged on the top side of the support portion of the support element and should preferably also include a central opening in order to be able to implement the preceding assembly method for the support element. Cutting plates of this type can for example be used for surface treatment, in particular in cases where a particular surface quality in the sense of a high level of evenness of the machine surface shall be achieved. Using chisels, however, is rather typical in the field of coarse material removal.

Besides using a large cutting plate as a cutting element also attaching a cutting tool of this type on the top side of the support element is feasible, wherein the cutting tool has plural cutting elements which are configured as cylindrical cutting inserts which are preferably formed from PCD or hard metal.

Such cutting elements, in particular the ones made from PCD are used in particular fields of surface treatment where high wear resistance of the cutting elements is required in water to be able to achieve acceptable service lives. Arranging plural cutting inserts at the cutting tool allows the user in analogy to the proceeding explanation to disengage the support element from the fixation element, to rotate it in the receiver and to orient a "fresh" and unused and consequently not worn cutting insert so that it subsequently engages the material to be processed while the cutting insert that is already worn is "deactivated".

Depending on the field of application of the device it can be particularly advantageous when the tool holder is formed through a base holder and a change holder, wherein the base holder is preferably welded together with the roller element and the change holder is disengageably connected with the base holder and furthermore includes the receiver for form locking receiving of the support element. Subdividing the tool holder into a base holder and change holder is performed due to the extremely high mechanical loading that all elements of the device are subjected to. Thus, the cutting tool, either in the form of a round shaft chisel or in the form of a cutting element is subjected to the highest amount of wear. The support element is also strongly affected which as describe supra has a lot of wear due to the high support forces of the cutting tool, wherein the present invention substantially simplifies replacing the support element.

The loading of the tool holder is significantly reduced relative to the support element but still existent. Consequently, also the tool holder has to be exchanged in certain intervals. When the tool holder is provided as an integral component which is directly welded to the roller element such change of the tool holder is associated with significant complexity. Therefore dividing the tool holder in two components (base holder, change holder) can be very useful since in such case only the base holder would be welded together with the roller element, whereas the change holder can be disengageably connected with the base holder, for example threaded together. A threaded connection of this type is disengageable in a much simpler manner than a welded connection, so that replacing the change holder is greatly simplified compared to a change holder of a one piece tool holder.

The process of mounting the support element is already described supra. When a change of a support element is performed the fixation element can be typically kept since it is subjected to no wear or only little wear. After disengaging the threaded connection of both components consequently only the support element needs to be replaced while the fixation element preferably remains directly in the receiver of the tool holder. In order to implement this in a particularly simple manner in practical applications it should be provided for the duration of the change of the support element to provide a locking device which contacts a bottom side of the fixation element through a blocking section so that lifting the support surface of the support portion of the fixation element from the support surface of the tool holder is blocked, wherein the blocking device is preferably connected with the tool holder through a support groove arranged at the tool holder in a form locking manner which supports the blocking device relative to the tool holder.

Disengaging the threaded connection between the support element and the fixation element as a matter of consequence coincides with a relative movement of both components relative to one another in a direction of the longitudinal axis of the receiver. In case an escape movement of the fixation element in a direction of the bottom side of the receiver is prevented as described by the blocking device, disengaging the threaded connection automatically leads to a movement of the support element in a direction of the top side of the receiver of the tool holder. This has the advantage that the threading process through the assembly tool for bolts induces a lift off force into the support element which leads to a lift off of the corresponding support surfaces of the support element and the tool holder. Since components, the tool holder and the support element can almost get "glued" together very tightly during milling operations due to the high support forces and the typically moist clay containing and thus highly cohesive and adhesive material ablation, the lift off force can be very comfortably used for overcoming this "gluing". Using the blocking device thus not only supports the fixation element to remain in place while changing the support element, but furthermore also supports the disengagement of the support element from the tool holder.

In order to be able to disengage the blocking device again that is attached in the support groove of the tool holder, the blocking device should include a recess in which a rod shaped, preferably arcuate lever element is insertable, wherein a surface orthogonal of a recess plane shall preferably be aligned substantially parallel to a longitudinal axis of the tool holder. The lever element which can be formed for example by a typical chisel extractor can be inserted into the recess of the blocking device. By levering with the lever element against the tool holder consequently a force can be applied to the blocking device, wherein the force is oriented away from the tool holder so that the blocking device is disengaged.

When mounting the tool holder on the roller element a correct orientation of the tool holder has to be observed in particular since its orientation determines the position of the cutting tool. When the tool holder is oriented imprecisely relative to the rotation of the roller element insufficient cutting power of the associated cutting tool can occur or alternatively excessive wear when an engagement depth of the cutting tool becomes greater than planned or a contact angle for example between the cutting tool and the material is not set in an optimum manner. Therefore the tool holder should be aligned preferably through an alignment element at the roller element. An alignment element of this type is preferably a relatively small and light element which is alignable on the roller element in a significantly simple manner and subsequently attachable thereon in a simpler manner than this would be the case for an optionally rather massive and bulky tool holder. The assembly sequence using the alignment element is consequently performed so that initially the alignment element which typically has a flat bottom side is attached at the roller element, preferably welded. Thus, the correct position of the alignment element needs to be observed. As soon as the alignment element is permanently connected with the roller element the tool holder can be subsequently attached at the roller element through docking at the alignment element, wherein preferably a form locking between the tool holder and the alignment element is implemented, wherein only an unambiguous orientation of the tool holder is feasible and the tool holder consequently also has to be correctly positioned if the alignment element was correctly mounted.

In order to implement the form locking between the tool holder and the alignment element it is for example feasible that the alignment element has at least one pinion on a top side which engages in a form locking manner with at least one corresponding recess of the tool holder, wherein a rotation of the tool holder is blocked relative to the alignment element through this form locking engagement.

In order to provide state of the art compatibility of such tool holder which is attached at the roller element with an alignment element connected there between it can be advantageous that the alignment element has at least two nipples at its bottom side which engage corresponding recesses of a support block, wherein the support block is connected with the roller element, preferably welded together therewith. This way an alignment element configured in this manner can also be connected with current base holders (herein bearing block) so that identical tool holders can always be used and only the alignment element which is much smaller and more economical compared therewith has to be adapted to the respective circumstances of the respective device. The alignment element described herein with two nipples on its bottom side is configured to engage a support block as described supra and which in turn has appropriate dimensions. Other shapes of the alignment element for adaptation to other base holders are also conceivable.

Last not least it is appreciated with respect to another advantageous embodiment of the tool holder that the tool holder should have a recess on a bottom side oriented towards the roller element in which the alignment element is completely insertable so that a bottom side of the alignment element oriented towards the roller element terminates flush with the bottom side of the tool holder. This embodiment is particularly advantageous for a direct connection of the tool holder with the roller element. Thus the alignment element can be used for alignment, and however since it completely disappears in the described recess of the tool holder a direct welding of the tool holder with the roller element is feasible so that sufficient stability can be provided.

Thus, the object of the present invention is furthermore achieved based on a method described supra including the following method step:

d) an assembly tool for bolts is inserted from a top side of the tool holder through the bore hole of the support element into an opening of the fixation element providing form locking engagement with the fixation element facilitating torque transfer.

The advantages of the method step of this type and its precise execution are already described supra.

It is also described supra that a method of this type is particularly advantageous in which the support element and also the fixation element are inserted from the top side of the tool holder into the receiver of the tool holder. Performing this method step is only possible using a safety ring which is inserted into the circumferential groove of the fixation element subsequent to inserting the fixation element into the receiver of the tool holder and which subsequently forms the support portion of the tool holder. Through the support portion a movement of the fixation element in a direction of the top side of the receiver is blocked. If this support portion is permanently arranged at the fixation element an insertion of the fixation element into the receiver from its top side would not be possible.

A threaded connection of the fixation element with the support element should preferably be performed through an assembly tool for bolts which includes a safety pin which is insertable into a receiver of the assembly tool for bolts, wherein the safety pin prevents a relative movement between the assembly tool for bolts and the fixation element in a direction of the top side of the tool holder. The assembly process using a safety pin of this type is performed so that initially the assembly tool for bolts is inserted from the top side of the tool holder through the bore hole of the support element into the opening of the fixation element. Due to the form locking between the assembly tool for bolts and the fixation element turning the assembly tool for bolts simultaneously provides a rotation and consequently provides a threaded connection of the fixation element with the support element. In order to facilitate an engagement of the threads of the fixation element and the support element it is advantageous for both threaded sections to be pressed against one another. This is also possible using the described safety pin. For this purpose only the assembly tool for bolts has to protrude from the opening with an end section at the side oriented away from the support element so that the receiver which should be arranged in the end section of the assembly tool for bolts is freely accessible. Subsequently the safety pin is inserted into he receiver, wherein the length of the safety pin is greater than the diameter of the opening of the fixation element. Removing the assembly tool for bolts in a direction towards the top side of the tool holder is therefore not possible using the safety pin since the assembly tool for bolts is blocked by the safety pin which is supported at a bottom side of the fixation element. Consequently the user can impart a force upon the assembly tool for bolts that is directed towards the top side of the tool holder and can thereby cause the fixation element and the support element to be pressed against one another. When a torque is simultaneously applied to the assembly tool for bolts by the user, threading the support element and the fixation element into one another can be performed in a particularly simple manner.

The method according to the invention is furthermore particularly advantageous during disengaging the threaded connection of support element and fixation element when the fixation element is supported against a movement in axial direction of the receiver of the tool holder, so that during disengagement of the threaded connection only the support element performs a movement from the receiver in a direction oriented away from the fixation element. Such blocking of the movement of the fixation element in axial direction of the receiver of the tool holder is implemented on the one hand side by the support portion (a movement in a direction of the top side is prevented) and can furthermore be provided through a blocking device described supra (movement in a direction oriented away from the receiver). Alternatively it can also be the case that due to space constraints at the bottom side of the receiver of the tool holder a blocking device as described supra does not become necessary since an escapement of the fixation element into a direction oriented away from the receiver is already prevented by components of the device itself. If this is not the case preferably a blocking device should be used. The advantages of preventing any movement of the fixation element during disengagement of the threaded connection between the support element and the fixation element is already described supra.

Eventually a method of this type is particularly advantageous in which an alignment element is arranged on the tool holder before mounting the tool holder on the roller element, preferably the alignment element is welded to the tool holder and the tool holder is subsequently aligned with the alignment element relative to the roller element through form locking and the tool holder is connected with the alignment element and/or the roller element through form locking, preferably welded together. The advantages of this method can also be found in the preceding embodiments.

EMBODIMENTS

Figure 2:
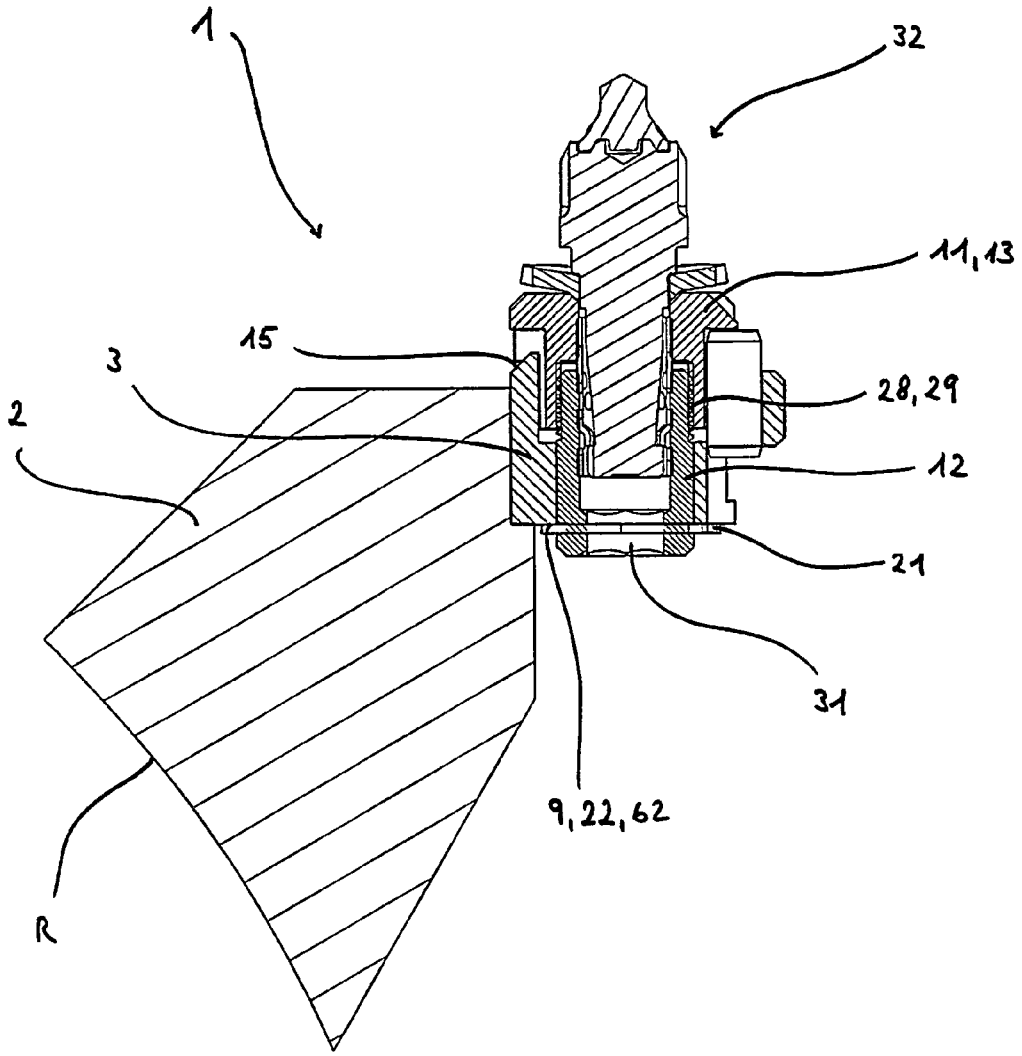
Figure 3:
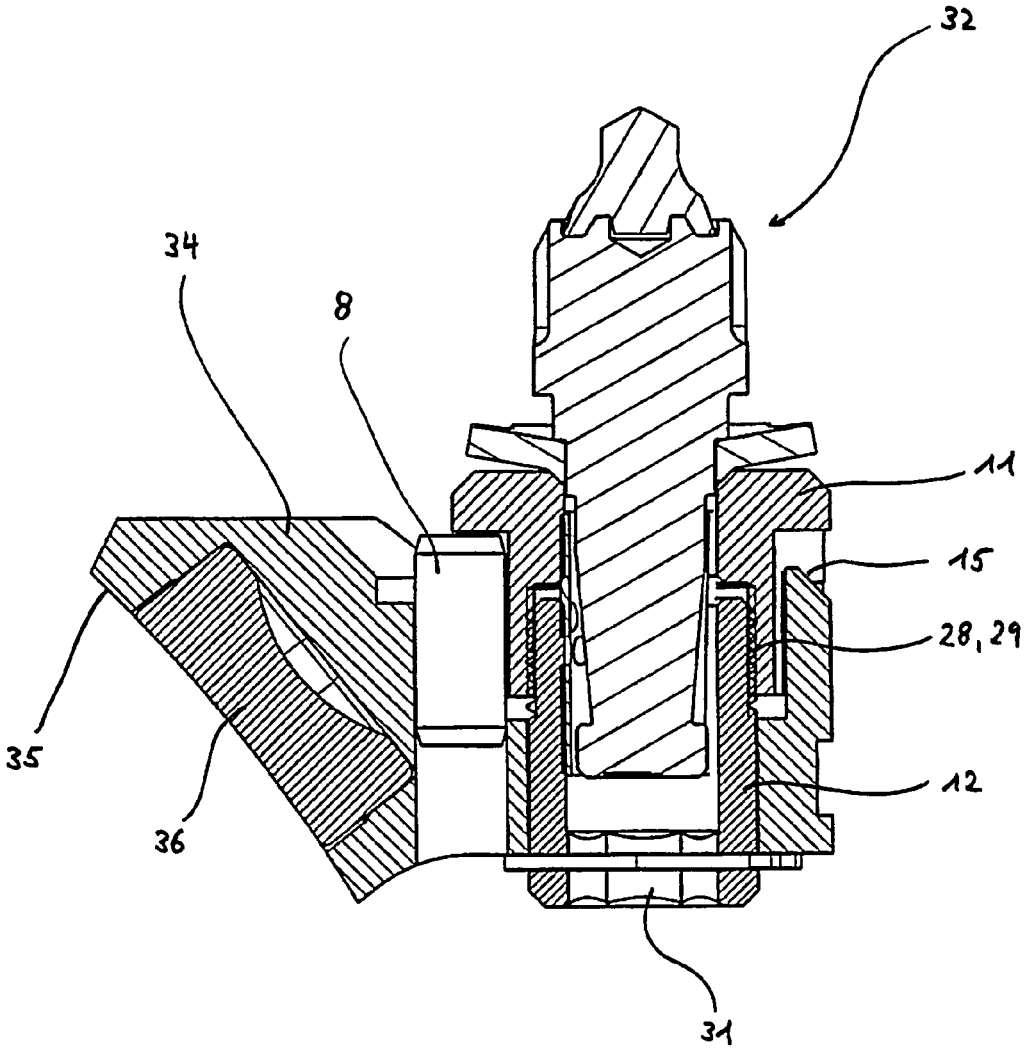
Figure 4:
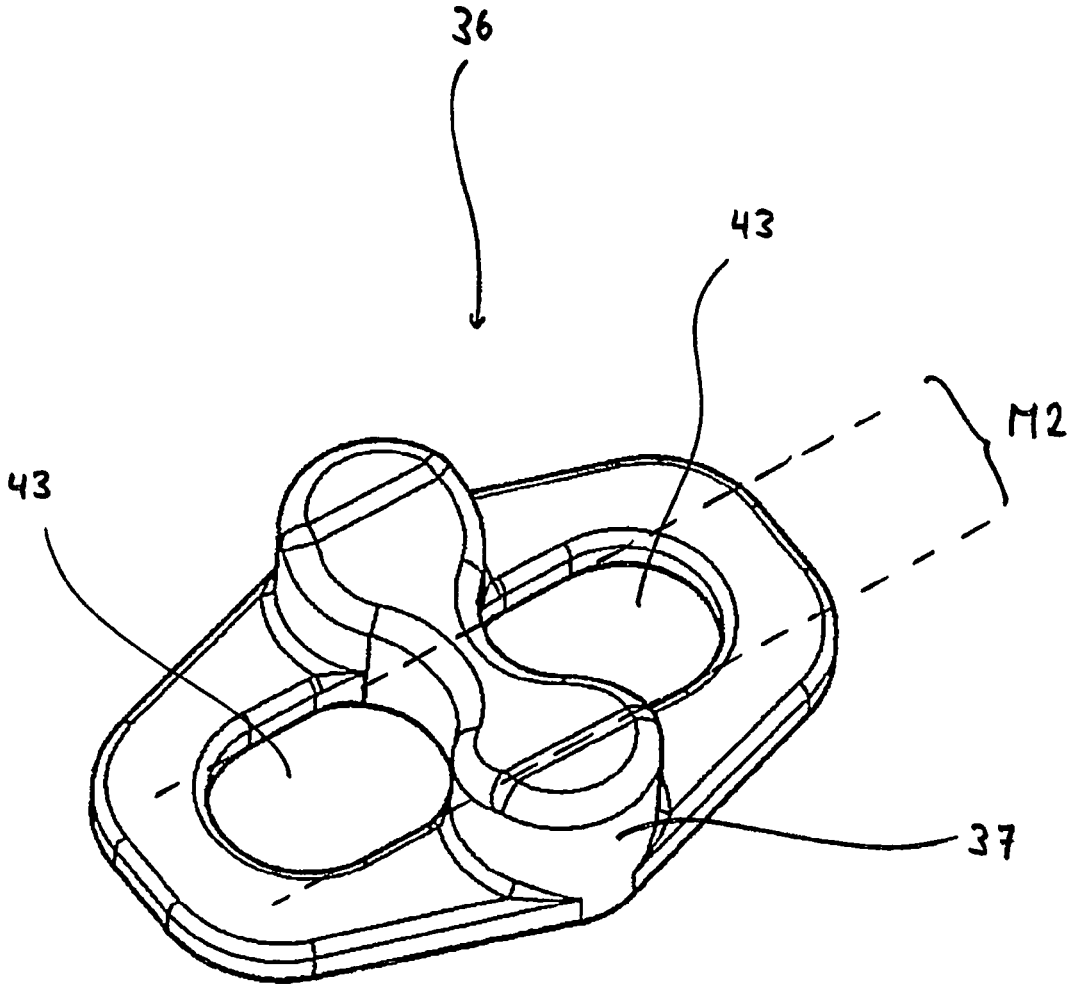
Figure 5:
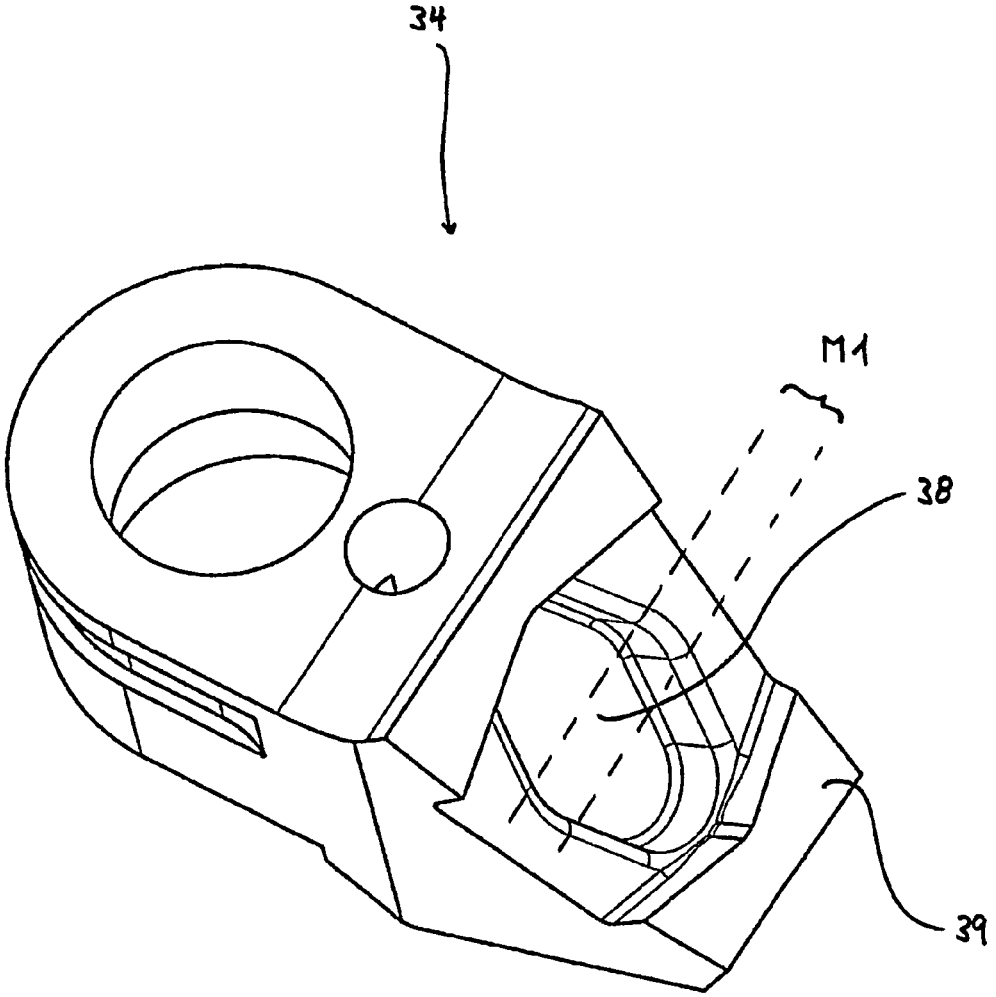
Figure 6:
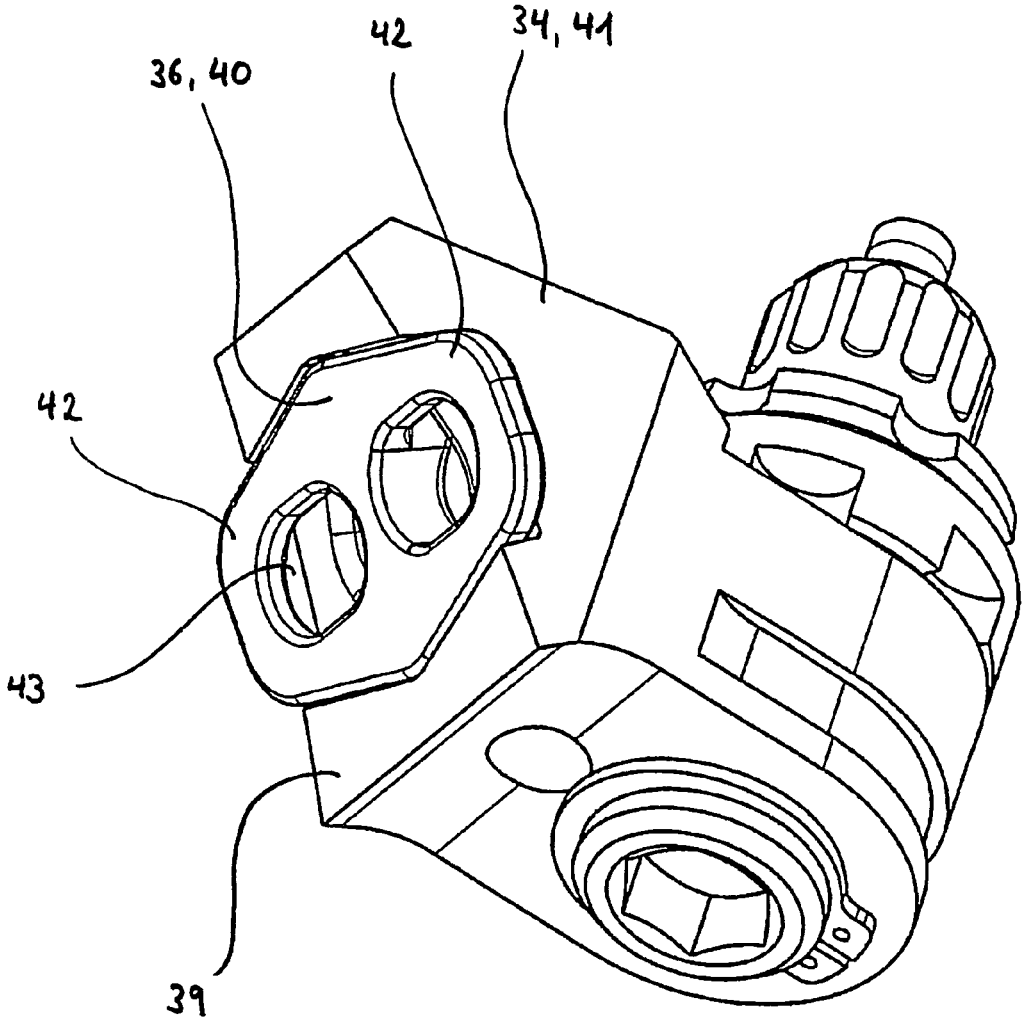
Figure 7:
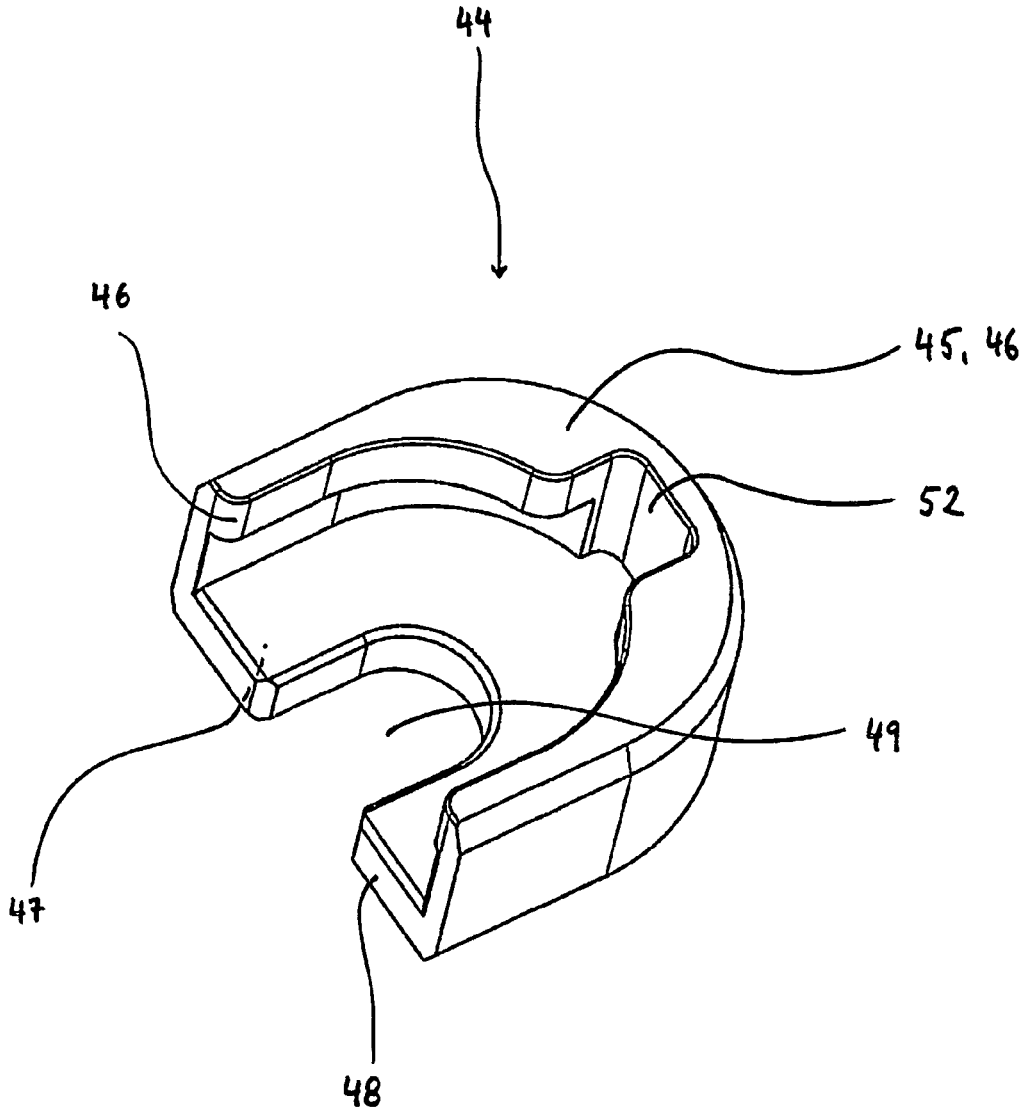
Figure 8:
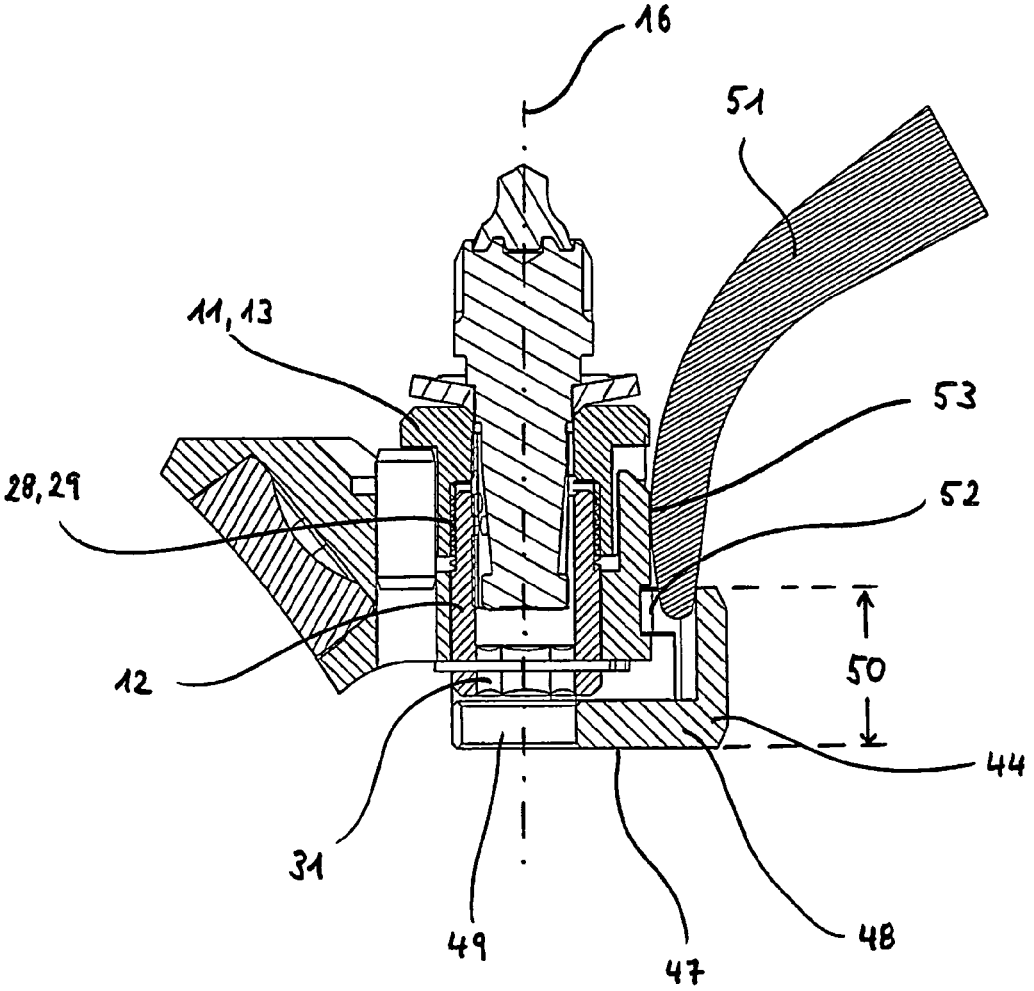
Figure 9A:
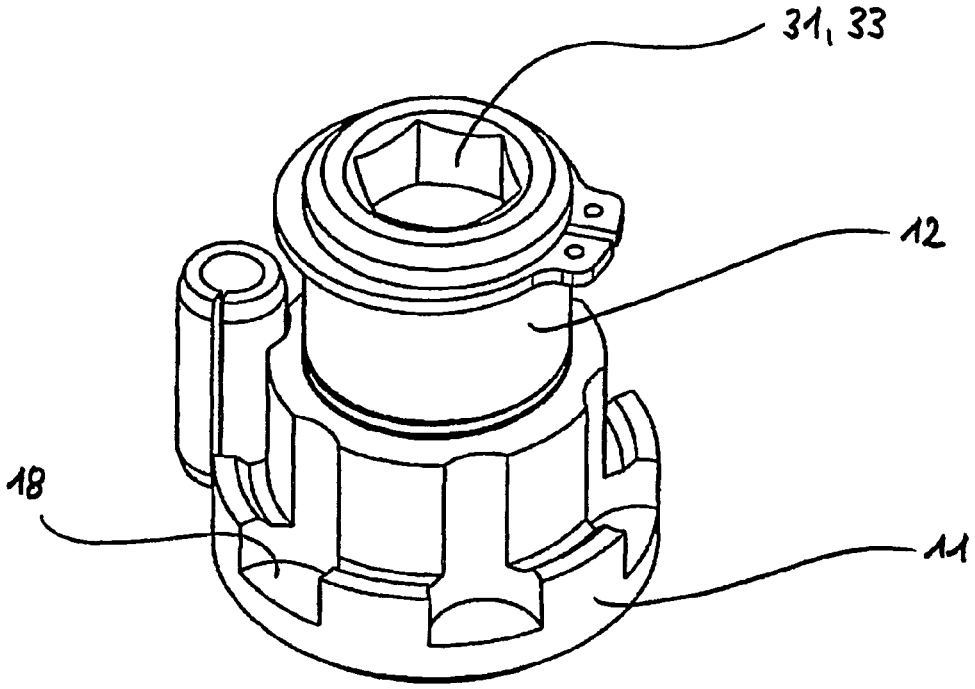
Figure 9B:
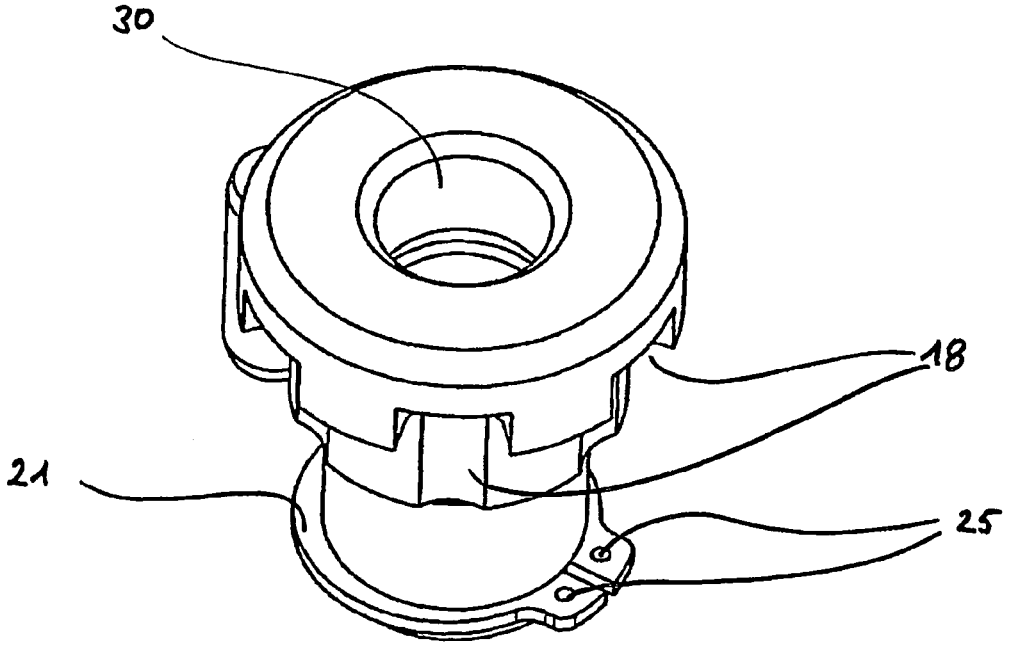
Figure 10A:
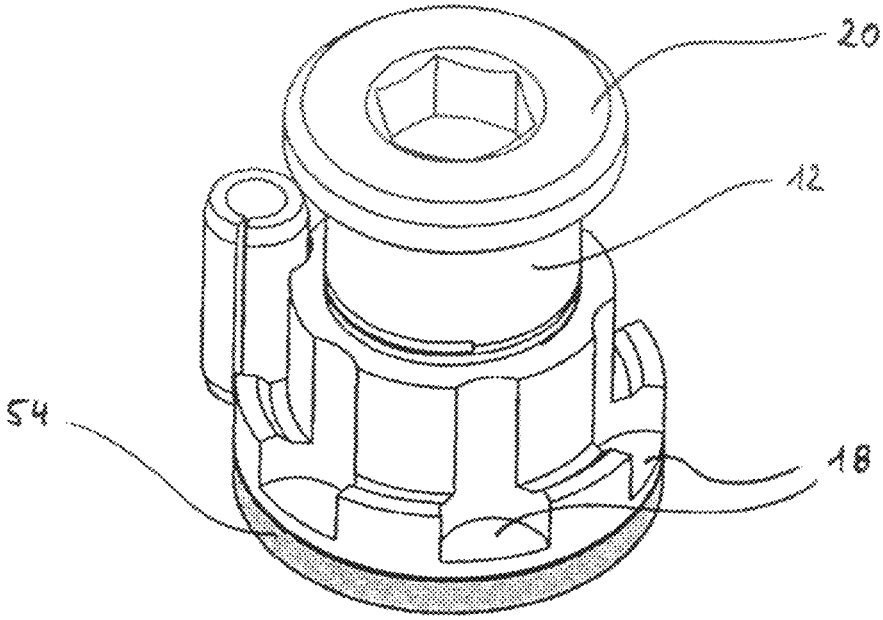
Figure 10B:
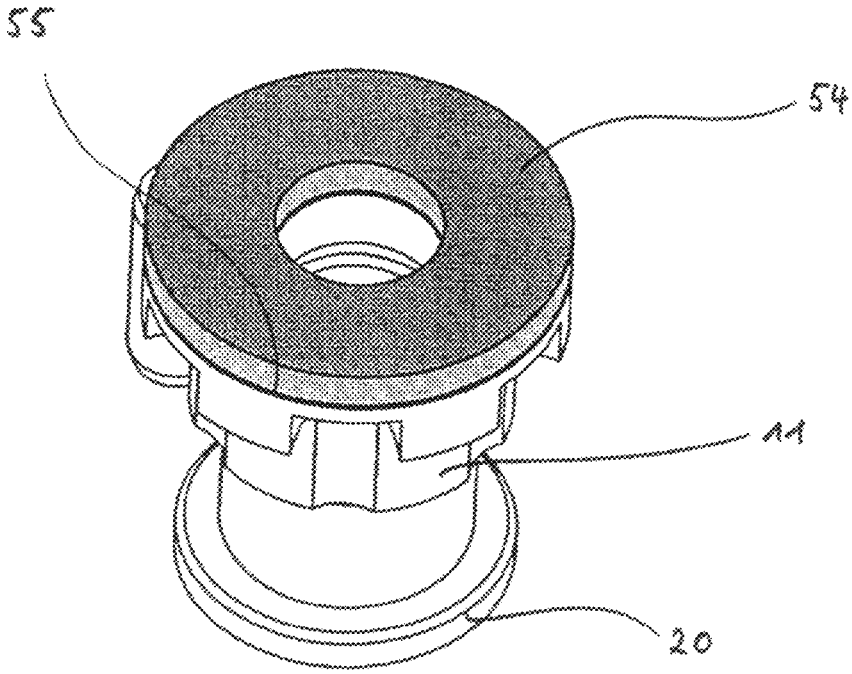
Figure 11A:
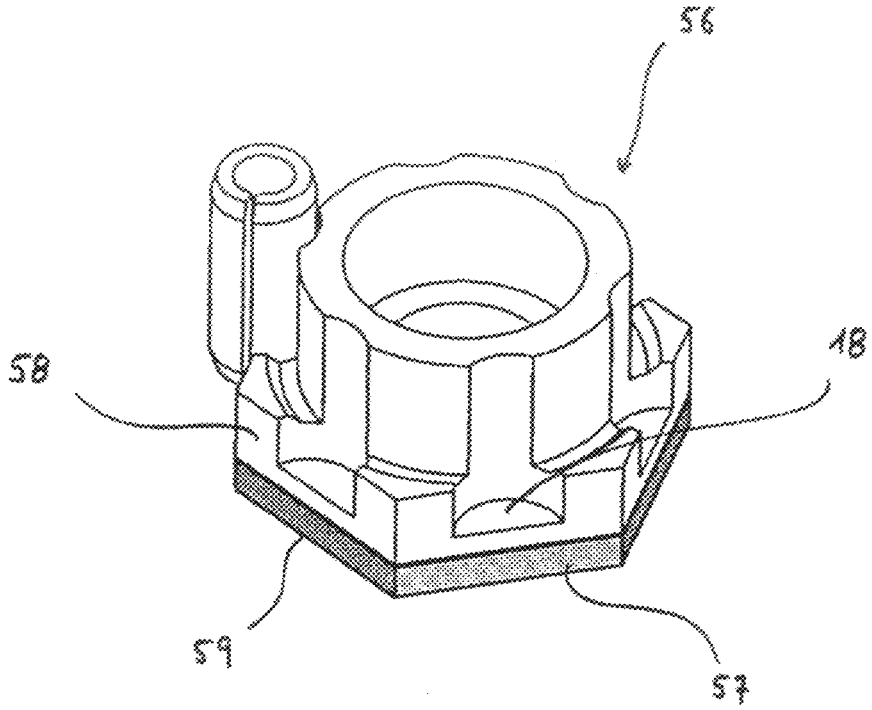
Figure 11B:
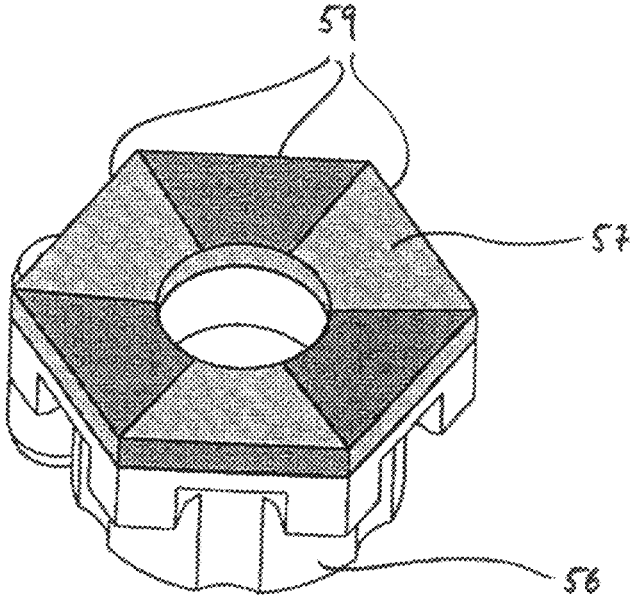
Figure 12A:
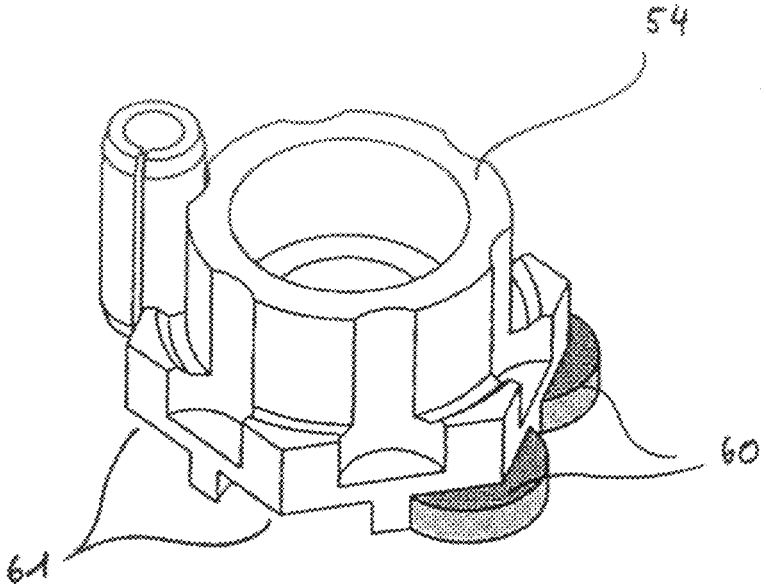
Figure 12B:
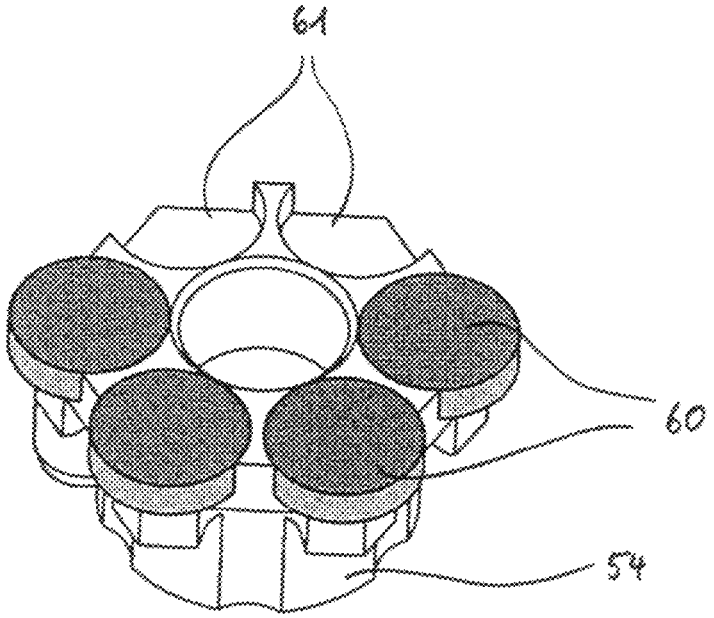
Figure 13:
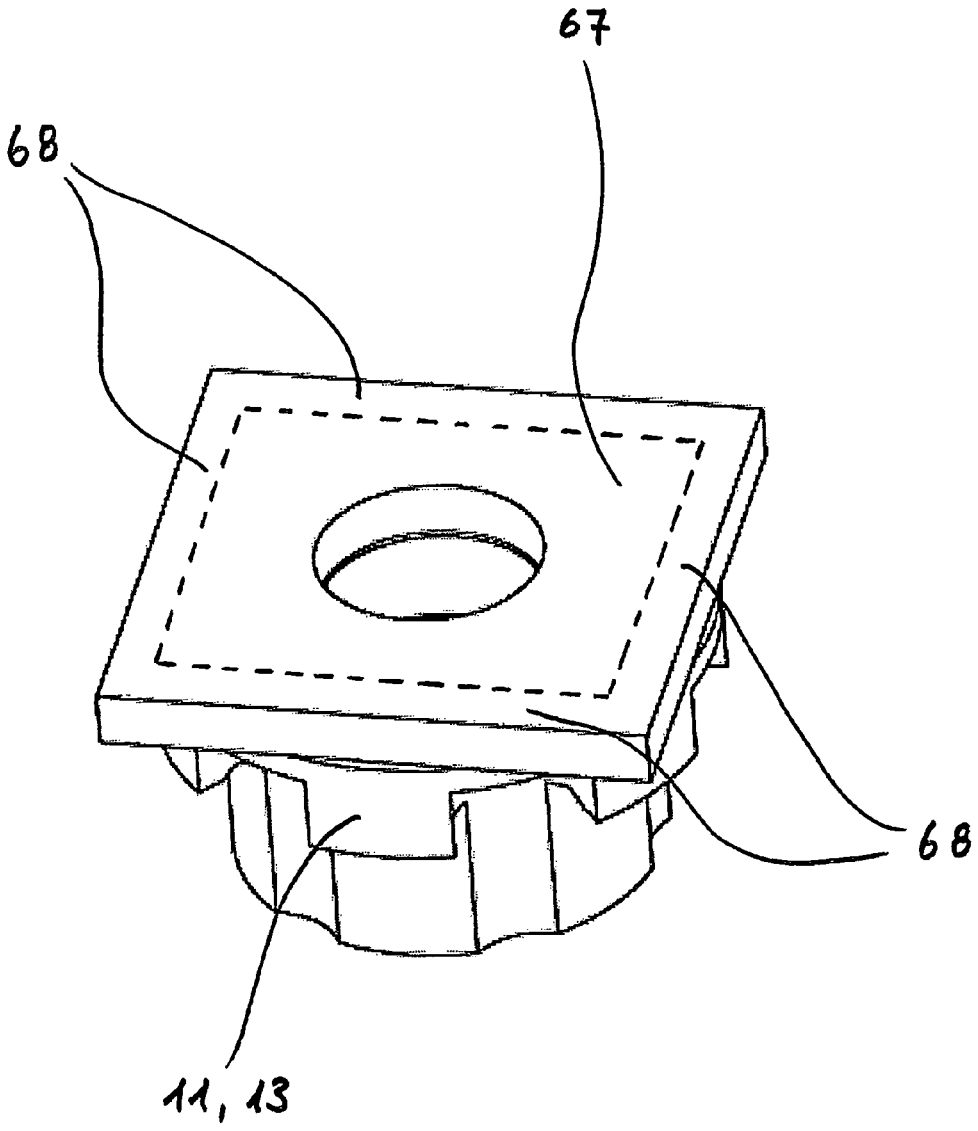
Figure 14:
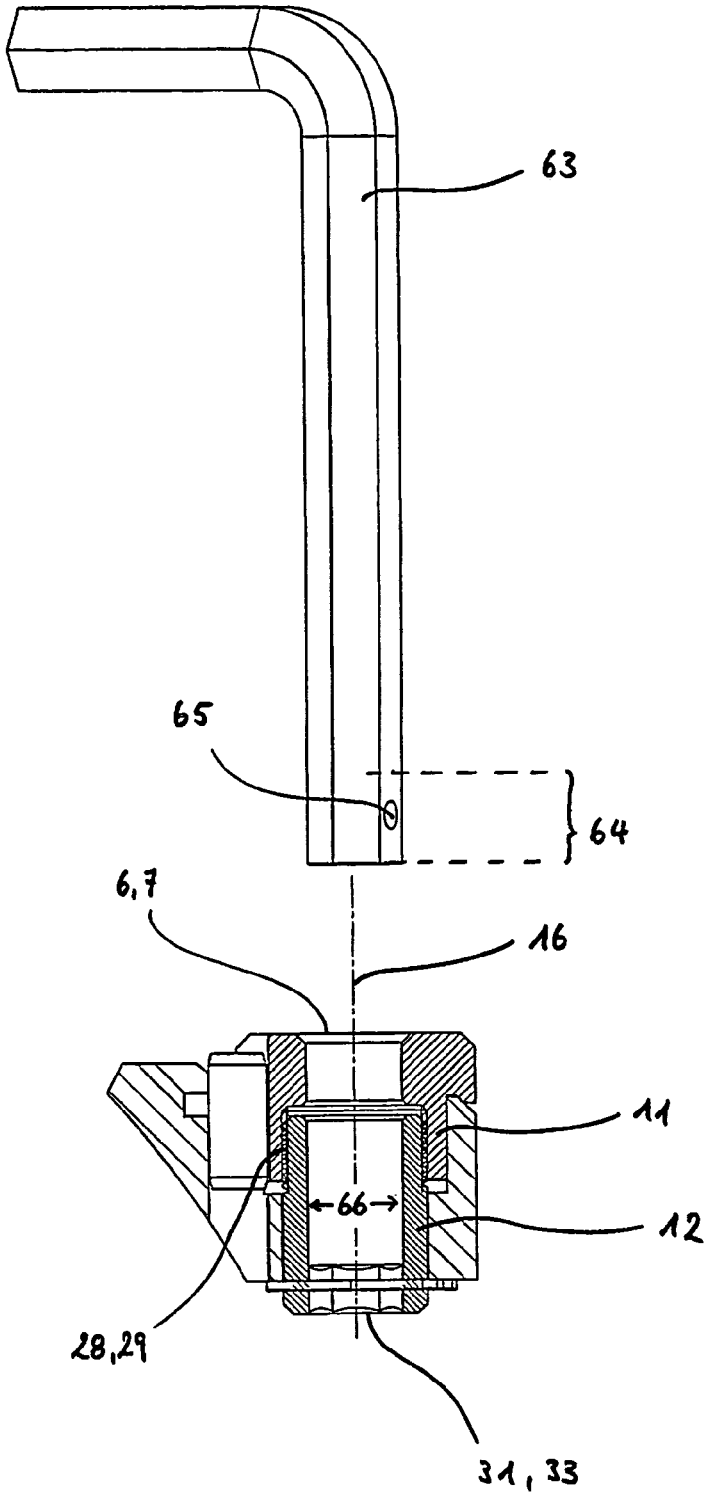

The invention is subsequently described based on embodiments with reference to drawing figures wherein:

FIG. 1: illustrates an exploded view of an equipped tool holder for use on a roller element with a large diameter;

FIG. 2: illustrates a sectional view of the device according to FIG. 1;

FIG. 3: illustrates a sectional view of another tool holder for use on a roller element with a small diameter;

FIG. 4: illustrates a detail of an alignment element;

FIG. 5: illustrates an isometric view of a tool holder without alignment element;

FIG. 6: illustrates an isometric view of a tool holder including the alignment element;

FIG. 7: illustrates a detail of a blocking device;

FIG. 8: illustrates a sectional view of an equipped tool holder including a blocking device and a lever element;

FIG. 9*a*, 9*b*: illustrates a detail of a combination of a bearing element and a fixation element;

FIG. 10*a*, 10*b*: is similar to FIG. 9, but includes a cutting tool supported by the support element;

FIG. 11*a*, 11*b*: is similar to FIG. 9, but includes a second cutting tool supported by the support element;

FIG. 12*a*, 12*b*: is similar to FIG. 9, but includes a third cutting tool supported by the support element;

FIG. 13: is similar to FIG. 9 but includes an ejector plate supported by the support element; and FIG. 14: illustrates an assembly tool for bolts for threading a support element together with a fixation element.

In a first embodiment in FIG. 1 components of a completely equipped tool holder 1 are illustrated in an exploded view. The tool holder 1 is attached at a roller element that is not illustrated. The tool holder 1 illustrated herein includes two discreet elements, a base holder 2 and a change holder 3. At a bottom side of the base holder 2 a curved edge R is visible which is adapted to the radius of the roller element that is not illustrated. A circular arc shaped recess 5 is arranged at a face 4 of the based holder, wherein the recess is used for receiving the change holder 3.

The change holder 3 has a central recess which is designated as recess 6. Furthermore, the change holder 3 includes a pin shaped blocking element 8 at a top side 7, wherein the function of the blocking element is described infra. At a bottom side 9 of the change holder 3 a support groove 10 is additionally configured whose function is also subsequently described in more detail with reference to FIGS. 7 and 8.

The receiver 6 of the change holder 3 is used for receiving a support element 11 and a fixation element 12. The support element 11 includes a support portion 13 which extends beyond an inner diameter of D of the change holder 3, so that it is not possible to move the support element 11 through the receiver 6 of the change holder 3. Rather, the support portion 13 is used for securely supporting the support element 11 on the top side 7 of the change holder 3. For this purpose both portions, the support portion 13 at a bottom side 17 and the top side 7 of the change holder 3 include conically shaped support surfaces 14, 15 which engage in a form locking manner when the support element 11 is inserted in the receiver 6 of the change holder 3, so that forces transversal to a longitudinal axis 16 of the change holder 3 are transferable from the support element 11 to the change holder 3.

The support portion 13 of the support element 11 is configured at its bottom side 17 with a plurality of groves 18 which extend into an outer enveloping surface 19 of the support element 11. These grooves 18 are used for form locking engagement with the blocking element 8 so that torques imparted upon the support element 11 about the longitudinal axis 16 of the change holder 3 do not cause a rotation of the support element 11, but are reacted to the change holder 3 through form locking. An arrangement of plural grooves 18 provides the option to change the position of the support element 11 relative to the change holder 3. This way in case the wear of the support element 11 is not tolerable in a particular load direction the orientation of the support element 11 can be changed so that it becomes useable again. By rotating the support element 11 in all available positions which are defined by the grooves 18 the material of the bearing element 11 can thus be used to a maximum amount before it eventually has to be replaced.

The fixation element 12 in analogy to the support element 11 also has a support portion 20, wherein the support portion 20 is formed by a safety ring 21. This safety ring 21 also extends beyond the diameter D of the change holder 3 so that it cannot be moved through the receiver 6 of the change holder 3. Instead, the safety ring 21 with the support surface 22 arranged at its top side suitable is for supporting at a corresponding support surface 62 of the change holder 3. The safety ring 21 is inserted into a circumferential groove of the fixation element 12 and consequently fixated thereon. Furthermore the safety ring 21 is slotted at a location 24 so that it can be slipped onto the fixation element 12 through expanding. Two openings 25 offer the capability to prevent a repeated expanding of the safety ring 21 after sliding it onto the fixation element 12, namely during milling operations by connecting both ends of the safety ring 21 with one another at a location 24.

By forming the support portion 20 of the fixation element 12 through the safety ring 21 a support portion 20 that is permanently connected with the fixation element 12 can be omitted. Therefore it is possible during assembly of the fixation element 12 at the change holder 3 to insert the fixation element 12 without the safety ring 21 from the top side 7 of the change holder 3 into the receiver 6 until the groove 24 on the bottom side 9 of the change holder 3 protrudes from the receiver 6. Subsequently the safety ring 21 can be inserted into the groove 23 in order to prevent a renewed movement of the fixation element 12 in a direction towards the top side 7 of the change holder 3. Through this procedure mounting the fixation element 12 is also possible when there are particular space constraints on the bottom side 9 of the change holder 3.

A threaded section 27 is arranged at a top side 26 of the fixation element 12, wherein the threaded section includes an external thread 28. The external thread 28 is configured to engage an inner thread 29 of the support element 11, wherein the inner thread is not visible in FIG. 1 (c. f. FIG. 2). This way, the support element 11 and the fixation element 12 are connectable with one another in a form locking manner so that the support element 11 and also the fixation element 12 are securely received in the receiver 6 of the change holder 3.

In the illustrated embodiment the support element 11 and also the fixation element 12 include a bore hole 30 and a opening 31, wherein the latter is particularly visible in FIGS. 9*a* and 10*a* and includes an inner hexagonal socket. The bore hole 30 in the bearing element 11 is primarily used for receiving a cutting tool, in the illustrated embodiment this is a round shaft chisel 32. Additionally it serves a particular purpose during assembly of the bearing element 11 and of the fixation element 12. An assembly tool for bolts 63 can be inserted through the bore hole 30 during the assembly into the receiver 6 into the hexagonal opening 21, wherein the assembly tool for bolts is illustrated in FIG. 13. For best efficiency the assembly tool for bolts 63 should also have a hexagonal shape so that it can engage the opening 31 at a bottom side 33 of the fixation element 12 with form locking engagement and a tight fit. The outer thread 28 and the inner thread 29 can now be connected with one another through rotating the assembly tool for bolts 63 without requiring access to the fixation element 12 from the bottom side 9 of the change holder 3.

This is particularly advantageous when there are space constraints and leads to a significant facilitation of applying the support element 11.

The round shaft chisel 32 is an embodiment that is commercially available and known in the art so that no further explanations are required.

FIG. 2 illustrates the particular components in assembled condition described with reference to FIG. 1. Herein it is visible how the external thread 28 of the fixation element 12 engages the internal thread 29 of the support element 12. It is furthermore apparent that the safety ring 21 is supported with its support surface 22 against the support surface 22 at the bottom side 9 of the change holder 3.

FIG. 3 illustrates another embodiment of the tool holder 34 which differently from the prior embodiment is not made from two discrete components but configured integral in one piece. In the sectional view of FIG. 3 a respective surface of a roller element that is not illustrated is indicated by a curved edge 35. For milling operations the tool holder 34 is directly welded together with the roller element.

Before this is performed a so called alignment element 36 is used which is illustrated separately in FIG. 4. Through this alignment element 36 it is facilitated in a particularly simple manner to correctly position the tool holder 34 on the roller element. A positioning of this type can be critical because it requires a high precision of execution. The advantage of using the alignment element 36 is that the step of welding the tool holder 34 can be performed in two discrete steps. This can be described in a particularly simple manner based on FIGS. 4 and 5.

It is illustrated in FIG. 4 in an exemplary how the alignment element 36 can be shaped. It includes a pinion 37 which can be inserted in a form locking manner in a respective recess 38 that is visible form FIG. 5 at a bottom side 39 of the tool holder 34. The length of the recess 38 is adapted to the length of the pinion 37 so that only an unambiguous orientation of the tool holder 34 relative to the alignment element 36 is feasible since the pinion 37 is only insertable into the recess 38 in one orientation. Thus it is visible from FIG. 5 that a shape of the recess 38 does not correspond to the shape of the pinion 37 but includes an expansion in a center portion M1, whereas the pinion 37 includes a contraction in a center portion M2. This serves a particular purpose which shall be described infra. The position of the tool holder 34 on the roller element using an alignment element 36 is performed as follows:

The pinion 37 of the alignment element 36 is inserted into the recess 38 of the tool holder 34. This condition is illustrated in FIG. 6. The bottom side 39 of the tool holder 34 is configured so that the alignment element 36 can be completely received by the tool holder 34 and therefore the bottom side 39 terminates flush with a bottom side 40 of the alignment element 36. This provisional and non form locking interconnection of the tool holder 34 and the alignment element 36 is subsequently positioned on the roller element, wherein a particular orientation of the tool holder 34 needs to be observed. When this alignment has been performed, end portions 42 of the alignment element 36 that protrude beyond lateral surfaces 41 of the tool holder 34 (c.f. FIG. 6) can be spot welded to the roller element. Since the alignment element 36 is rather small and thus light, such punctiform connection between the roller element and the alignment element suffices for the time being to fixate the alignment element. After this fixation of the alignment element 36 the tool holder 34 can be removed again in a preliminary manner without losing the correct orientation since this orientation is now defined by the alignment element 36. When the tool holder 34 is removed the alignment element 36 can be eventually connected with the roller element by adding additional welds. The welds should be typically arranged in the center portion M2 of the alignment element 36, wherein the alignment element 36 has two cut outs 43 along whose inner edges welds of this type can be arranged in a particularly simple manner.

When the alignment element 36 is eventually fixated at the roller element the tool holder 34 can be subsequently placed back on the roller element, wherein the pinion 37 in turn engages the recess 38 on the bottom side 39 of the tool holder 34 in a form locking manner. At this location it becomes apparent why the recess 38 and the pinion 37 are shaped differently in their center portions M1 and M2 (an expansion at the recess 38 versus a contraction at the pinion 37, c.f. FIGS. 4 and 5). As described supra the alignment element 36 is provided with welds in the portion of the cut outs 43 at the contraction of the pinion 37. In case the recess 38 of the tool holder 34 is identically shaped to the pinion 37 it could occur due to the welds that a complete placement of the tool holder 34 onto the alignment element 36 is not possible since the welds require a particular space in the center portion of M2 of the alignment element 36 and can thus block the tool holder 34. An expansion in the center portion of the recess 38 of the tool holder 34, however, prevents such collision between the welds and the tool holder 34, so that the tool holder 34 can be placed on the alignment element 36 with a precise fit.

Subsequently, the tool holder 34 can be circumferentially welded onto the roller element. The advantage of using the alignment element 36 is that the tool holder 34 due to the form locking with the alignment element 36 is fixated at its mounting location and does not have to be supported in a correct position during the welding process through manual force of the user. Due to the considerable mass of some tool holders 34 this can be of substantial advantage of the safe and correct alignment of the tool holder 34.

In the portion of the support element 11 of the fixation element 12 and of the round shaft chisel 32 the second embodiment (FIG. 3) is being considered identical to the first embodiment (FIGS. 1 and 2) described supra. The only exception is a position of the pin shaped blocking element 8 which contrary to the change holder 3 from the preceding embodiment is arranged at a side oriented towards the roller element. This function, however, is thus not changed in any way.

The cutting tool like for example the round shaft chisel 32 is subjected to high wear during milling operations. Due to the high support forces which are transmitted by the cutting tool to the support element 11 the same applies also for the support element 11. This has the effect that the latter needs to be replaced now and then so that milling operations can be continued. Such change of the support element 11 can be implemented in a particularly simple manner using a blocking device 44. An embodiment of the blocking device 44 of this type is illustrated in FIG. 7. It includes a circumferentially protruding edge 46 at a top side 45. This edge 46 is used for fixating a blocking device 44 in a support groove 10 for example of the change holder 3 from the first embodiment. Through form locking engagement of the edge 46 in the support groove 10 it is provided that the blocking device 44 cannot be moved in a direction of the longitudinal axis 16 of the receiver 6 of the change holder 3. A bottom side 47 of the blocking device 44 is substantially formed through a planar terminal plate 48 which includes a recess 49.

Looking at FIG. 8 it becomes apparent how the terminal plate 48 and also the recess 49 operate as soon as the blocking device 44 is arranged at the change holder 3. A height 50 of the blocking device 44 is selected so that the terminal plate 48 is positioned directly under the bottom side 33 of the fixation element 12 when the blocking device 44 is inserted into the support groove 10. Consequently the fixation element 12 cannot be moved into a direction that is oriented away from the receiver 6 of the change holder 33. However, when the support element 11 has to be changed initially the round shaft chisel 32 has to be removed from the bore hole 30 of the support element 11 as described supra so that the assembly tool for bolts 63 can be inserted from the top side 7 of the change holder 3 into the bore hole 30 and can engage the hexagonal opening 31 at the bottom side 33 of the fixation element 12 in a form locking manner. Through a rotation of the assembly tool for bolts 63 the connection between the support element 11 and the fixation element 12 configured as engaging threads of the outer thread 28 of the fixation element 12 and of the inner thread 29 of the support element 11 can be disengaged. This can be performed through a linear movement of both elements relative to one another in a direction of the longitudinal axis 16 of the recess 6. Due to the blocking device 44, however, a movement of the fixation element 12 is prevented as described supra. This as a matter of consequence forces the support element 11 to move in a direction of the top side 7 of the change holder 3, wherein the fixation element 12 remains in place. This recess 49 of the blocking device 44 is only used for simpler handling of the assembly tool for bolts 63. In case there is no recess 49 the assembly tool for bolts 63 can only be precisely inserted into the opening 31 of the fixation element 12. Applying force, however, is simpler when the assembly tool for bolts 63 can be run through the opening 31. Due to the recess 49 of the blocking device 44 whose diameter precisely coincides with the diameter of the opening 31 this is easily feasible.

Using the blocking device 44 during disassembly of the support element 11 has two essential advantages. It is assured on the one hand side through the blocking device 44 that the fixation element 12 remains in the receiver 6 of the change holder 3 even after disengaging the fixation element from the support element 11 and the fixation element does not fall out of the receiver in a direction that is oriented away from the receiver 6. On the other hand side the blocking device 44 as described supra as a matter of consequence prevents a lift off of the support portion 13 of the support element 11 from the top side 7 of the change holder 3. Both elements, the support element 11 and the change holder 3 can strongly adhere to one another due to material removal during milling operations since the typically very humid and thus strongly cohesive material leads to both components gluing together. A gluing of this type can be overcome in a relatively simple manner through a rotation applied through the assembly tool for bolts 63, so that the support element 11 and the change holder 33 are separated from one another.

The embodiment of the blocking device 44 of FIG. 8 furthermore illustrates a lever element 51 which after switching the support element 11 is used for disengaging the edge 46 of the blocking device 44 from the support groove 10 of the change holder 3 again. For this purpose the edge 46 of the blocking device 44 includes an opening 52 (c.f. FIG. 7). This opening 52 should be optimally arranged in a direction of the top side 7 change holder 3 so that a surface orthogonal on an opening plane of the opening 52 is oriented approximately in parallel to the longitudinal axis 16 of the receiver. Through such orientation of the opening 52 it is facilitated in particularly simple manner to insert the lever element 51 from the top side 7 into the opening 52 and to disengage the blocking device 44 from the support groove 10 through a lever movement, wherein the lever element 51 is supported against an outer enveloping surface 53 of the change holder. The blocking device 44 can thus be recovered without destruction and can consequently be used over and over again indefinitely.

The other FIGS. 9-12 illustrate embodiments of configurations of the support element 11, wherein FIGS. 10-12 illustrate alternative types of cutting tools which are not classical round shaft chisels 32. Thus, FIGS. 9*a* and 9*b* illustrate 2 views of a fixation element 12 in combination with a support element 11. The opening 31 on the bottom side 33 of the fixation element 12 is particularly apparent from FIG. 9*a* wherein the opening has a hexagonal shape. All other elements and properties have already been described supra.

The embodiment according to FIG. 10 illustrates an alternative cutting tool wherein the cutting tool is a cutting plate 54 in the form of a circular ring. The cutting plate 54 is made from hard metal and thus has high resistance relative to a material to be removed during cutting operations. The cutting tool is arranged on a top side 55 of the support element 11, preferably welded together therewith. Through the grooves 18 and the blocking element 8 it is feasible analogously to the preceding description to rotate the support element 11 including the cutting tool configured as cutting plate 54 supported by the support element 11. This way the support element can be rotated when excessive wear of the engagement portion of the cutting plate 54 occurs, so that a portion that was not used so far is brought into engagement with the material to be processed during further cutting operations. This way a maximum utilization of the cutting plate 54 is feasible before an exchange is required.

In FIG. 10*a* furthermore an embodiment of the fixation element 12 is visible which deviates from the preceding prescription. Thus, the support portion 20 of the fixation element in the illustrated embodiment is not formed by a safety ring 21 but is permanently connected with the fixation element 12 analogous to the support portion 13 of the support element 11. Inserting the fixation element 12 into a receiver from a top side of the tool holder is not feasible using such fixation element 12.

According to another embodiment for a cutting tool FIG. 11 illustrates a support element 56 including a cutting tool mounted thereon which cutting tool is configured as a hexagonal cutting plate 57. The support element 56 differs from the support element 11 in that a support portion 58 of the support element 56 has a polygonal shape, wherein the support portion of the support element 11 has a rounded shape. A difference between the cutting plates 54 and 57 apparently lies in their geometries. These different geometries lead to different surface results during cutting operations. While the circular ring shaped cutting plate 54 generates a surface structure which is characterized by a small amount of grooves and peaks using a straight cutting edge 59 as provided by the square cutting plate 57 it is feasible to provide completely planar surfaces. In particular where high surface quality is required using a square cutting plate 57 can be advantageous.

In another embodiment FIG. 12 illustrates a cutting tool which is assembled from a plurality of particular cutting inserts 60. The top side 55 of the square support element 56 includes a total of 6 recesses 61 which are respectively for receiving a cutting insert 60. In FIG. 12 only four cutting inserts 60 are illustrated in an exemplary manner. For cutting operations, however, all recesses 61 of the support element 56 are typically equipped. The cutting inserts 60 respectively have cylindrical shapes and are made from PCD. A cutting tool of this type is used in particular for high performance grinding operations with high abrasive wear wherein the PCD is used that is much harder and wear resistant than normal hard metal in order to facilitate longer service lives of the cutting tool. As soon as one of the cutting inserts 60 is worn, rotating the support element 56 facilitates activating another cutting insert 60 wherein the previously worn cutting insert is deactivated.

As an alternative to applying a cutting tool with different shapes, for example according to FIGS. 9-12 it is furthermore feasible to provide the support element 11 with a rectangular, preferably square ejector plate 67 as illustrated in the embodiment according to FIG. 13. The ejector plate 67 is formed from hard metal or PCD in the edge portions 68 so that it has high wear resistance in the edge portions 68. In order to use a device including for example the tool holder 34, the support element 11, the fixation element 12 and the ejector plate 67, wherein the device is configured as an ejector or a stripping bar a plurality of these devices have to be arranged adjacent to one another so that the edge portion 68 of adjacent ejector plates 67 respectively arranged on support elements 11 contact one another. The stripper bar therefore has no gaps or similar so that milled off material is always captured and removed from a cutting area in which the cutting tools engage the material to be processed. Typically the material is transported by the ejector to a rear cavity arranged opposite to the side of the cutting cavity of the roller element and is subsequently moved from there to a conveyor belt or similar which removes the material. Since the ejector plate 67 is preferably provided reinforced in all edge portions (hard metal PCD) the ejector plate can also be rotated analogous to the preceding prescription through rotating the support element 11 and thus the ejector plate can be used in an optimum manner before a change of the ejector plate 67 is required. The support element 11 should accordingly include four grooves 18 for this application, wherein the grooves are accordingly arranged offset by 90°.

Last not least FIG. 14 illustrates an embodiment of the cutting tool 63 through which a threaded connection between the support element 11 and the fixation element 12 can be provided. For this purpose the assembly tool for bolts 63 is inserted from the top side 7 along the longitudinal axis 16 of the tool holder 34 into the receiver 6 of the tool holder 34 until the assembly tool for bolts protrudes with an end section 64 at the bottom side 33 of the fixation element 12. Subsequently a non illustrated safety pin can be inserted into a receiver 65 which is arranged in the end section 64 of the assembly tool for bolts 63. The safety pin should thus have a length which is greater than an inner diameter 66 of the fixation element 12. This way it is no longer feasible after applying the safety pin to pull the assembly tool for bolts 63 from the receiver 6 in a direction of the top side 7 of the tool holder. Instead, it is feasible to press the safety pin against the bottom side 33 of the fixation element 12 through applying a force in a direction of the top side 7 and to push the fixation element 12 in this way with its exterior thread 28 against the interior thread 29 of the support element 11. Through such reinforced contact between the two threads it is feasible in a much simpler manner to thread the fixation element 12 together with the support element 11. FIG. 13 illustrates the completed threaded connection.

REFERENCE NUMERALS AND DESIGNATIONS

1 tool holder
2 base holder
3 change holder
4 face
5 recess
6 receiver
7 top side
8 blocking element
9 bottom side
10 retention groove
11 support element
12 fixation element
13 support portion
14 support surface
15 support surface
16 longitudinal axis
17 bottom line
18 groove
19 enveloping surface
20 support portion
21 safety ring
22 support surface
23 groove
24 location
25 opening
26 top side
27 thread section
28 exterior thread
29 interior thread
30 bore hole
31 opening
32 round shaft chisel
33 bottom side
34 tool holder
35 edge
36 alignment element
37 pinion
38 recess
39 bottom side
40 bottom side
41 side surface
42 end portion
43 cut out
44 blocking device
45 top side
46 edge
47 bottom side
48 cover plate
49 recess
50 height
51 lever element
52 opening
53 enveloping surface
54 cutting plate
55 top side
56 support element
57 cutting plate
58 support portion
59 cutting edge
60 cutting insert
61 recess
62 support surface
63 assembly tool for bolts
64 end section
65 receiver
66 inner diameter
67 ejector plate
68 edge portion
D inner diameter
K contour
M1 center portion
M2 center portion

The invention claimed is:

1. A device comprising a roller element rotatably supported about a longitudinal axis, at least one tool holder, a support element for supporting a cutting tool and a cutting tool, wherein the tool holder includes a receiver receiving the support element in a form locking manner and the support element includes a bore hole, wherein a fixation element is connected in a force transferring manner with the support element through a threaded connection, wherein the fixation element is arranged coaxial with the support element, wherein the support element and also the fixation element respectively include a support portion, wherein each of the support portions protrudes in a radial direction beyond the receiver of the tool holder and is supported with a support surface of the respective support portion, wherein the support surface is respectively oriented towards the tool holder and supported at a respective corresponding support surface of the tool holder, wherein the support portion of the fixation element is formable by a safety ring that is removable without destruction, and wherein the safety ring is supported in a circumferential groove of the fixation element.

2. The device according to claim 1, wherein the fixation element includes an exterior thread in a thread section, and wherein the exterior thread is engageable with an interior thread of the support element.

3. The device according to claim 1, wherein the support element is connected in plural positions rotated about a longitudinal axis of the support element with the tool holder through form locking.

4. The device according to claim 1, wherein the fixation element includes an opening.

5. The device according to claim 1, wherein the bore hole of the support element is configured as a support bore hole for rotatably supporting a cutting tool.

6. The device according to claim 1, wherein the support element includes a permanently attached cutting tool at a top side.

7. The device according to claim 1, wherein the tool holder is made from a base holder and a change holder, and wherein the change holder is disengageably connected with the base holder and furthermore includes the receiver for receiving the support element in a form locking manner.

8. The device according to claim 1, further comprising a blocking device which contacts a bottom side of the fixation element through a blocking section so that a lift off of the support surface of the support portion of the fixation element from the support surface of the tool holder is blocked, wherein the blocking device is supported at the tool holder.

9. The device according to claim 1, wherein the tool holder is aligned at the roller element through an alignment element.

10. The device according to claim 9, wherein the tool holder includes a recess on a bottom side oriented towards a roller element into which recess the alignment element is completely insertable so that a bottom side of the alignment element oriented towards the roller element terminates flush with the bottom side of the tool holder.

11. A method for mounting a support element for supporting a cutting tool of a device, the device comprising a roller element rotatably supported about its longitudinal axis, at least one tool holder including a receiver, the support element including a bore hole, a fixation element and at least one cutting tool, wherein the method includes steps of:

a) connecting the at least one tool holder with the roller element;

b) arranging the support element and the fixation element individually in the receiver of the at least one tool holder;

c) threadably engaging the support element with the fixation element; and d) inserting an assembly tool for bolts from a top side of the tool holder through the bore hole of the support element into a bore hole of the fixation element providing form locking engagement therewith configured to transfer torque between the assembly tool for bolts and the fixation element.

12. The method according to claim 11, wherein the support element and the fixation element are inserted into the receiver of the tool holder from the top side of the tool holder.

13. The method according to claim 11, wherein a safety ring is arranged in a circumferential groove of the fixation element after inserting the fixation element into the receiver of the tool holder, and wherein the safety ring forms a support portion of the fixation element, so that a movement of the fixation element in a direction of the top side of the tool holder is prevented.

14. The method according to claim 11, wherein a relative movement between the assembly tool for bolts and the fixation element in a direction of the top side of the tool holder is blocked through a safety pin which is insertable into a receiver of the assembly tool for bolts.

15. The method according to claim 11, wherein disengaging the threaded connection of the support element and the fixation element includes supporting the fixation element against a movement in axial direction of the receiver of the tool holder so that only the support element performs a movement from the receiver into a direction that is oriented away from the fixation element when the threaded connection is disengaged.

16. The method according to claim 11, wherein an alignment element is arranged on the tool holder before mounting the tool holder on the roller element, wherein the tool holder is subsequently aligned relative to the roller element providing a form locking engagement with the alignment element, and wherein the tool holder is connected in a form locking manner with the alignment element and/or the roller element.

17. A device comprising a roller element rotatably supported about a longitudinal axis, at least one tool holder, a support element for supporting a cutting tool and a cutting tool, wherein the tool holder includes a receiver receiving the support element in a form locking manner and the support element includes a bore hole, wherein a fixation element is connected in a force transferring manner with the support element through a threaded connection, wherein the fixation element is arranged coaxial with the support element, wherein the tool holder is made from a base holder and a change holder, and wherein the change holder is disengageably connected with the base holder and furthermore includes the receiver for receiving the support element in a form locking manner.

* * * * *